US012487052B2

(12) United States Patent
Geissele et al.

(10) Patent No.: US 12,487,052 B2
(45) Date of Patent: Dec. 2, 2025

(54) STOCK FOR A FIREARM

(71) Applicant: WHG Properties, LLC, North Wales, PA (US)

(72) Inventors: William H. Geissele, Lower Gwynedd, PA (US); Frank Eric Robinson, Schwenksville, PA (US)

(73) Assignee: WHG Properties, LLC, North Wales, PA (US)

( * ) Notice: Subject to any disclaimer, the term of this patent is extended or adjusted under 35 U.S.C. 154(b) by 71 days.

(21) Appl. No.: 18/310,915

(22) Filed: May 2, 2023

(65) Prior Publication Data

US 2024/0369322 A1 Nov. 7, 2024

(51) Int. Cl.
*F41C 23/04* (2006.01)

(52) U.S. Cl.
CPC ..... *F41C 23/04* (2013.01)

(58) Field of Classification Search
CPC ..... F41C 23/04; F41C 23/14
USPC ..... 42/71.01, 72, 73
See application file for complete search history.

(56) References Cited

U.S. PATENT DOCUMENTS

| | | | | |
|---|---|---|---|---|
| 7,162,822 | B1 | 1/2007 | Heayn et al. | |
| D712,998 | S | 9/2014 | Gomez | |
| D716,403 | S | 10/2014 | Burt | |
| D719,631 | S | 12/2014 | Ferko | |
| 9,052,155 | B2 * | 6/2015 | Fluhr | F41C 23/14 |
| 9,417,032 | B1 | 8/2016 | Chiang | |
| D769,396 | S | 10/2016 | Keller, II | |
| D773,593 | S | 12/2016 | Hopkins | |
| D810,225 | S | 2/2018 | Huang | |
| 10,060,699 | B1 | 8/2018 | Hu | |
| 10,215,526 | B2 * | 2/2019 | Shinkle | F41C 23/14 |
| D854,108 | S | 7/2019 | Menu | |
| D883,419 | S | 5/2020 | Windfeldt | |
| 10,788,287 | B2 * | 9/2020 | Parker | F41C 23/04 |
| D903,032 | S | 11/2020 | Swoboda | |
| D962,356 | S | 8/2022 | Gong | |
| 2012/0036757 | A1 * | 2/2012 | Larue | F41C 23/14 42/73 |
| 2012/0174457 | A1 | 7/2012 | Edelman | |
| 2016/0202016 | A1 * | 7/2016 | Mather | F41C 23/14 42/73 |
| 2017/0122698 | A1 * | 5/2017 | Chu | F41B 11/70 |
| 2019/0128639 | A1 * | 5/2019 | Parker | F41C 23/04 |
| 2023/0122203 | A1 * | 4/2023 | Keller | F41C 23/14 42/73 |

OTHER PUBLICATIONS

Omaha Outdoors, Q Honey Badger Stock Assembly [retrieved from Internet May 16, 2023] https://www.omahaoutdoors.com/q-honey-badger-stock-assembly/ (4 pages).

(Continued)

*Primary Examiner* — John Cooper
(74) *Attorney, Agent, or Firm* — Alston & Bird LLP

(57) ABSTRACT

A stock for a firearm includes a mount, a first member, and a second member. The mount is configured to be coupled to a main body of the firearm. The first member is configured to move along a longitudinal axis defined by the firearm relative to the mount. The second member is configured to move along the longitudinal axis relative to the first member.

20 Claims, 7 Drawing Sheets

(56) References Cited

OTHER PUBLICATIONS

Omaha Outdoors, q-ACC-HB-Stock Assembly [retrieved from Internet May 16, 2023] https://imaages.omahaoutdoors.com/q-ACC-HB-STOCK-ASSEMBLY-570x570.webp (1 pages).
Welcome To SNG Tactical! [retrieved from Internet May 16, 2023] https://www.sngtactical.com/custom/firearm-accessories-stocks-grips-handguards/brand/Maxim (4 pages).
SB Tactical, Pistol Stabilizing Braces / SBPOW [retrieved from Internet Feb. 21, 2023] https://www.sngtactical.com/custom/firearm-accessories-stocks-grips-handguards/brand/Maxim (5 pages).
SB Tactical, [retrieved from Internet May 16, 2023] https://www.sb-tactical.com/wp-content/uploads/2017/01/PDW_Black_Closed_Left_2626-RevStrapAug-Ghosted60.jpg (1 page).
Combathunting.com, RBU6BM UTG Pro Stock Kit AR-15 Mil-Spec 6 Position Collapsible Stock Assembly [retrieved from Internet May 16, 2023] https://www.co hunting.com/AR-15_M16_M4_Stocks-UTG_Pro_Made_in_USA_6-Position_Mil-Spec_Stock_Assembly.html (3 pages).
HolsterCo, AR-15/M16: OverMolded Collapsible Buttstock Assembly (Includes Mil-Spec Buffer Tube & Hardware)—Black [retrieved from Internet May 16, 2023] https://miholsterco.com/ar-15-m16-overmolded-collapsible-buttstock-assembly-includes-mil-spec-buffer-tube-hardware-black (4 pages).
Midway USA, Adaptative Tactical EX Performance Stock Collapsible Mil-Spec Diameter AR-15, LR-308 Carbine Polymer, [retrieved from Internet May 16, 2023] https://www.midwayusa.com/product/1018082482.
Geissele Automatics, Stocks [retrieved from Internet May 16, 2023] https://geissele.com/rifle-parts/lower-parts/stocks.html (8 pages).
Maxim Defense, PDW Brace [retrieved from Internet Feb. 21, 2023] https://www.maximdefense.com/product/pdw-brace/ (1 page).
International Search Report and Written Opinion for PCT/US2024/022966 (ISA/EP) dated May 29, 2024 (12 pages).

* cited by examiner

STOCK FOR A FIREARM

TECHNICAL FIELD

The present application relates generally to a stock for a firearm. More specifically, the present application relates to a collapsible and extendible stock for a firearm, and associated components, methods, and firearms.

BACKGROUND

Firearms often include stocks that are provided as a means for an individual to brace the firearm against their shoulder. The stock may increase the stability and/or accuracy of the firearm by increasing the ease as to which the firearm can be aimed and/or by countering a recoil force when the firearm is fired. Some types of firearm stocks may be collapsible and can be collapsed so that the firearm is more compact.

Traditional collapsible stocks, however, have numerous deficiencies and problems. For example, traditional collapsible stocks may not have a sufficient range of motion for a user's needs in both the collapsed and extended positions. As such, to make a more compact stock, it may be necessary to reduce the length of the stock in a fully extended state, which may decrease the stability and/or accuracy of the firearm when the stock is in the fully extended state. Similarly, to make a stock that increases the stability and/or accuracy of the firearm, the length of the stock in the fully collapsed state may need to be increased, which makes the firearm less compact, harder to store, harder to use in confined places, and harder to carry or conceal.

Additionally, traditional collapsible stocks often do not provide a suitable surface for an individual to place their cheek when aiming the firearm when in a fully collapsed state and in a fully extended state.

The inventors have identified numerous deficiencies and problems with the existing technologies in this field. Through applied effort, ingenuity, and innovation, many of these identified deficiencies and problems have been solved by developing solutions that are structured in accordance with the embodiments of the present disclosure, many examples of which are described in detail herein.

BRIEF SUMMARY

In general, embodiments of the present disclosure provided herein include apparatuses and methods for using the apparatuses to provide for improved firearms and/or improved stocks for firearms In various aspects, a stock for a firearm is provided. The firearm may have a main body and the stock may define a longitudinal axis. The stock may include a mount, a first member, and a second member. The mount may be configured to be coupled to the main body of the firearm. The first member may be configured to move along the longitudinal axis relative to the mount. The second member may be configured to move along the longitudinal axis relative to the first member.

In various examples, the stock may define a longitudinal direction and may include a release mechanism that is configured to be in a first position and in a second position. When the release mechanism is in the first position, the release mechanism may be configured to prevent a movement of the first member along the longitudinal axis relative to the mount. When the release mechanism is in the second position, the release mechanism is configured to allow the movement of the first member along the longitudinal axis relative to the mount.

In various examples, the release mechanism includes a movable component that is coupled to a wedge member. The wedge member may be configured to move with the movable component. The wedge member may include a first surface and a second surface that is adjacent to the first surface. The first surface may extend at a first angle relative to the longitudinal direction. The first angle may be at least twenty degrees and up to forty degrees. The second surface may extend at a second angle relative to the longitudinal direction. The second angle may be at least fifty degrees and up to seventy degrees.

In various examples, the longitudinal direction may define a forward direction and an aft direction. The release mechanism may include a biasing device that is coupled to the wedge member. The biasing device may be configured to bias the wedge member in the forward direction.

In various examples, the first member is configured to be in a first position and in a second position relative to the mount. The stock may include a forward guide rod that is coupled to the mount. The forward guide rod may include a first depression and a second depression. The release mechanism may include a deflectable component that is configured to move from the first depression to the second depression when the first member is moved from the first position to the second position.

In various examples, the stock includes a release mechanism that is configured to be in a first position and in a second position. When the release mechanism is in the first position, the release mechanism may be configured to prevent a movement of the second member along the longitudinal axis relative to the first member. When the release mechanism is in the second position, the release mechanism may be configured to allow the movement of the second member along the longitudinal axis relative to the first member.

In various examples, the stock defines a lateral direction and the release mechanism comprises a pair of movable components and a biasing device that is positioned between the pair of movable components in the lateral direction. The pair of movable components may be configured to compress the biasing device. A compression of the biasing device may be greater when the release mechanism is in the second position than when the release mechanism is in the first position.

In various examples, a forward guide rod is coupled to the mount and an aft guide rod is coupled to the second member. The first member may be slidingly engaged with the forward guide rod and the aft guide rod.

In various examples, the first member is configured to be in a first position and in a second position relative to the mount and the second member is configured to be in a first position and in a second position relative to the first member. When the first member and the second member are each in their respective first position, the stock may be in a fully collapsed state. When the first member and the second member are each in their respective second position, the stock may be in a fully expanded state. When one of the first member or the second member is in their respective first position and the other of the first member or the second member is in their respective second position, the stock may be in a partially extended state.

In various examples, the first member includes a cheek rest surface that extends circumferentially around the longitudinal axis at least 90 degrees. The second member may include a cheek rest surface that extends circumferentially around the longitudinal axis at least 90 degrees. A continuous cheek rest surface may extend from a position proximate to a forward end of the first member to a position proximate to an aft end of the second member.

In various aspects, a firearm is provided. The firearm may include a main body, a tube, and a stock. The main body may include a lower receiver. The tube may be coupled to the lower receiver. The tube may define a longitudinal axis and a circumferential direction that extends around the longitudinal axis. The stock may at least partially extend circumferentially around the tube.

In various examples, the stock includes a mount, a first member, and a second member. The mount may be configured to be coupled to the main body of the firearm. The first member may be configured to move along the longitudinal axis relative to the mount. The second member may be configured to move along the longitudinal axis relative to the first member.

In various example, the first member is configured to be in a first position and in a second position. The second member may be configured to be in a first position and in a second position. When the first member and the second member are in their respective first position, (i) the tube may be at least partially nested within the first member and (ii) the first member may be at least partially nested within the second member. When the first member and the second member are in their respective second position, the first member and the second member may be telescoped away from the firearm.

In various examples, the first member includes a cheek rest surface that extends circumferentially around the longitudinal axis at least 90 degrees. The second member may include a cheek rest surface that extends circumferentially around the longitudinal axis at least 90 degrees. The cheek rest surface may be configured such that an eye of an individual is aligned with a site of the firearm when a cheek of the individual is positioned on the cheek rest surface. A continuous cheek rest surface may extend from a position proximate to a forward end of the tube to a position proximate to an aft end of the second member.

The stock may include a release mechanism that is configured to be in a first position and in a second position. When the release mechanism is in the first position, the release mechanism may be configured to prevent a movement of the first member along the longitudinal axis relative to the mount. When the release mechanism is in the second position, the release mechanism may be configured to allow the movement of the first member along the longitudinal axis relative to the mount.

In various examples, the stock includes a release mechanism that is configured to be in a first position and in a second position When the release mechanism is in the first position, the release mechanism may be configured to prevent a movement of the second member along the longitudinal axis relative to the first member. When the release mechanism is in the second position, the release mechanism may be configured to allow the movement of the second member along the longitudinal axis relative to the first member.

In various aspects, a method for transitioning a stock for a firearm from a fully extended state to a fully collapsed state is provided. The method may include moving a first release mechanism of the stock from a first position to a second position. The method may include moving a first member of the stock in a forward direction from a second position to a first position when the first release mechanism is in the second position. The method may include moving a second release mechanism of the stock from a first position to a second position. The method may include moving a second member of the stock in the forward direction from a second position to a first position when the second release mechanism is in the second position. When the first member and the second member are in their respective second position, the stock may be in the fully extended state. When the first member and the second member are in their respective first position, the stock may be in the fully collapsed state.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

BRIEF DESCRIPTION OF THE DRAWINGS

Figure 1:
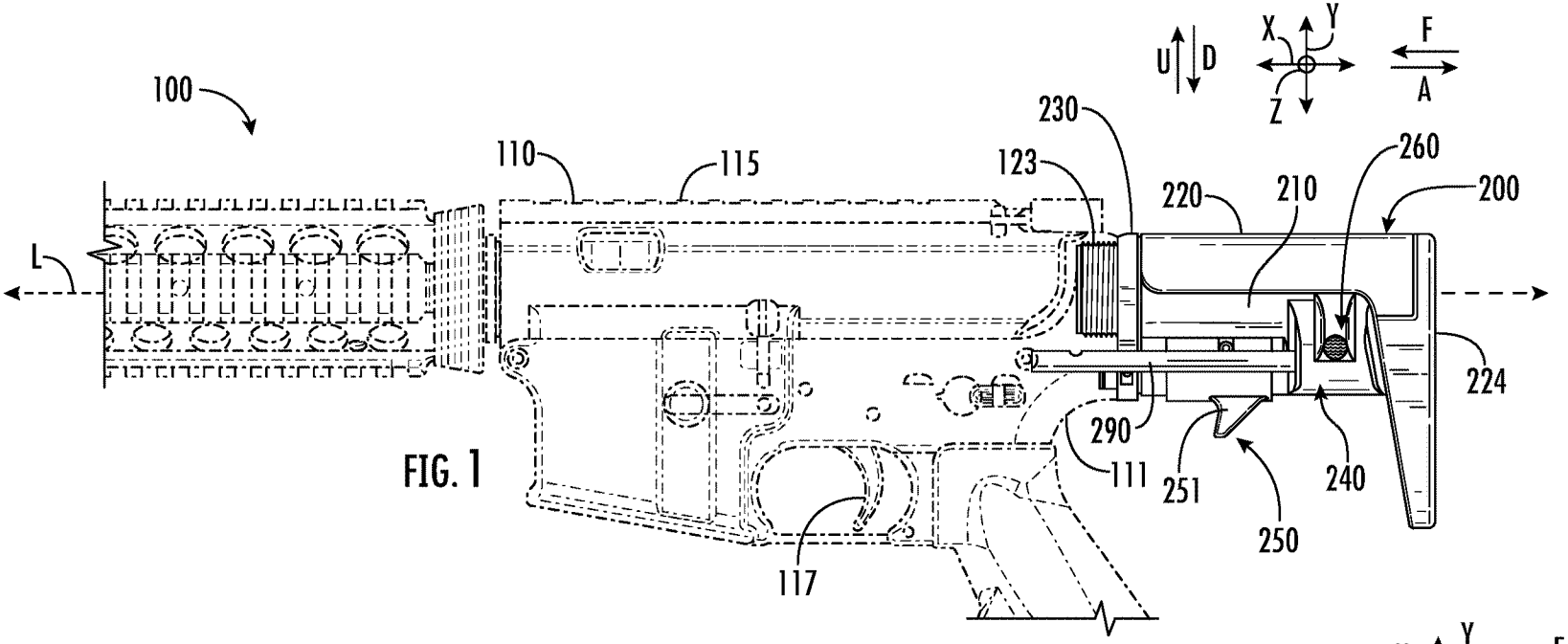

Having thus described certain example embodiments of the present disclosure in general terms above, non-limiting and non-exhaustive embodiments of the subject disclosure are described with reference to the following figures, which are not necessarily drawn to scale and wherein like reference numerals refer to like parts throughout the various views unless otherwise specified. The components illustrated in the figures may or may not be present in certain embodiments described herein. Some embodiments may include fewer (or more) components than those shown in the figures.

FIG. 1 provides a side view of a firearm that includes a stock in a fully collapsed state, in accordance with an example embodiment.

Figure 2:
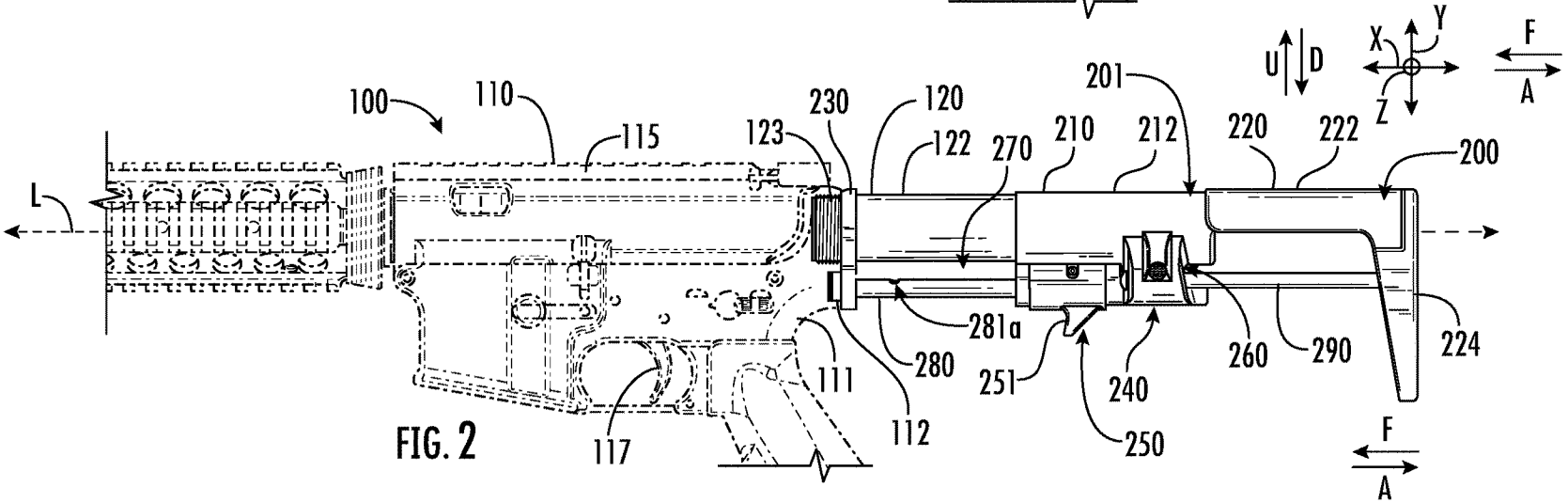

FIG. 2 provides a side view of the firearm of FIG. 1 with the stock in a fully extended state, in accordance with an example embodiment.

Figure 3:
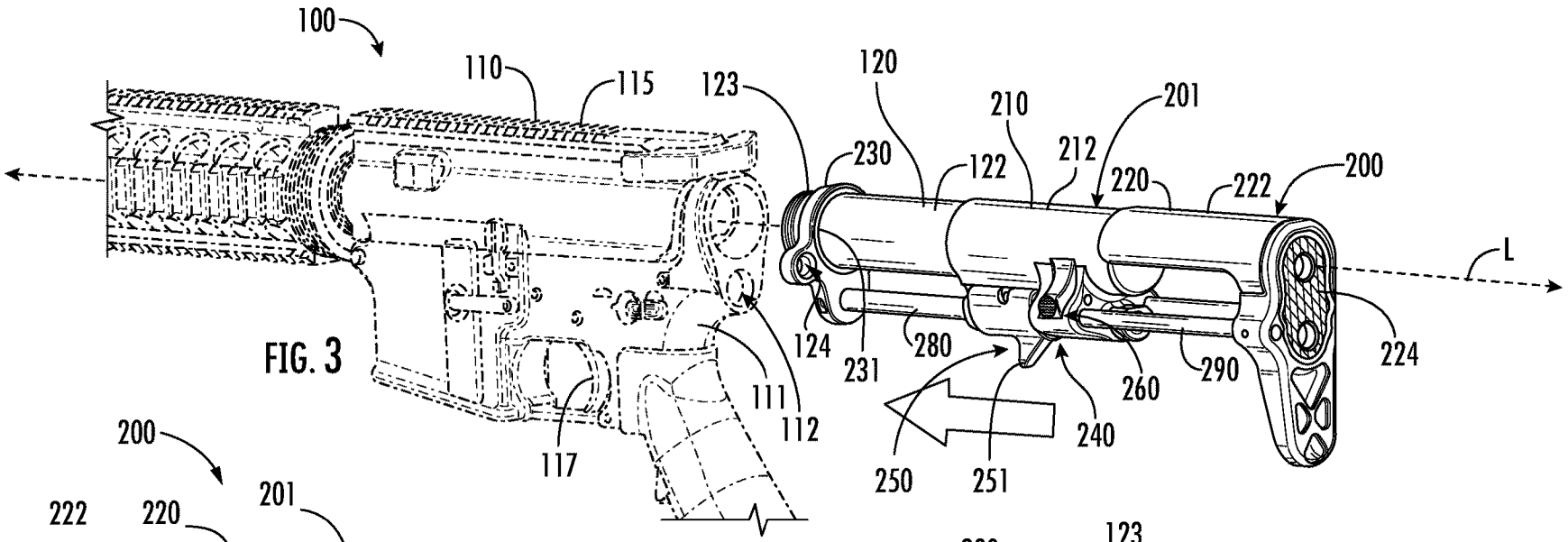

FIG. 3 provides a perspective side view of the firearm of FIG. 1 with the stock in a fully extended state, in accordance with an example embodiment.

Figure 4:
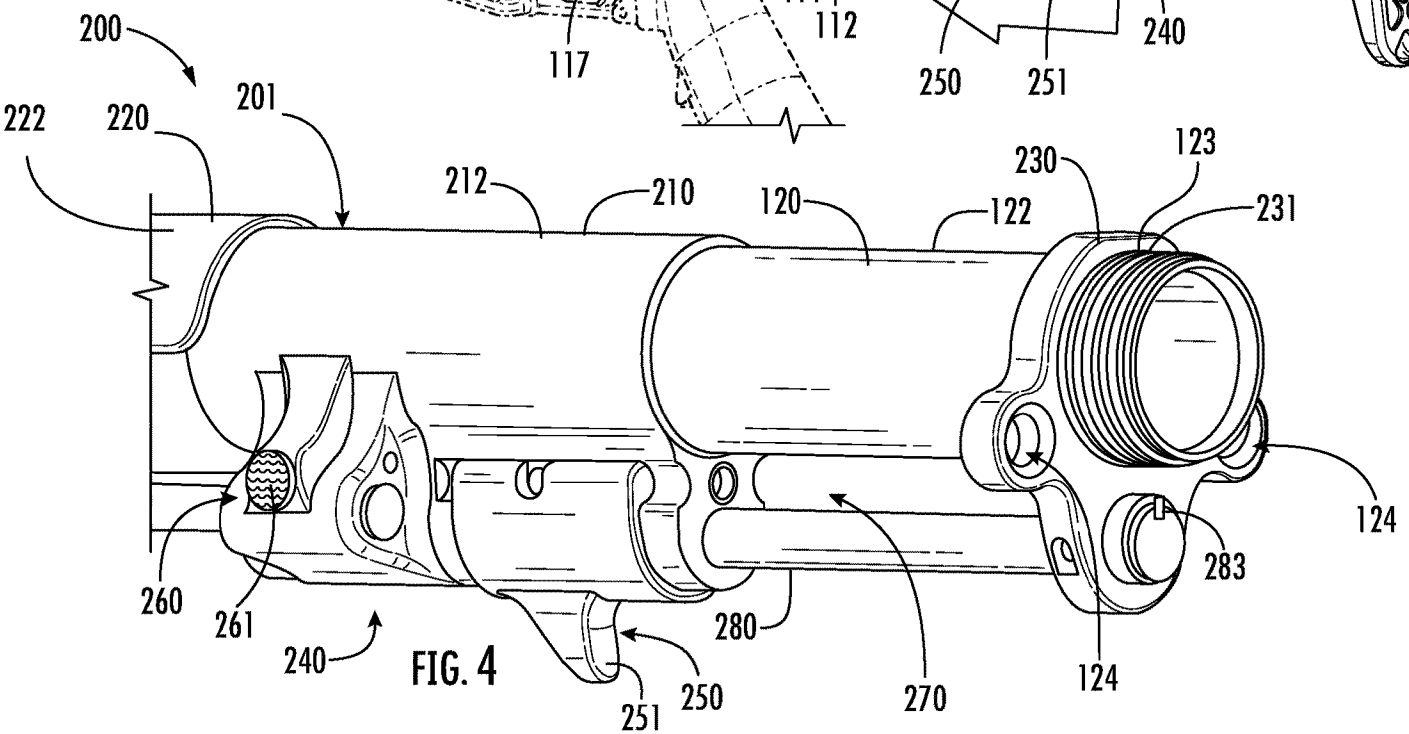

FIG. 4 provides a perspective view of the stock of the firearm of FIG. 1 in a fully extended state, in accordance with an example embodiment.

Figure 5:
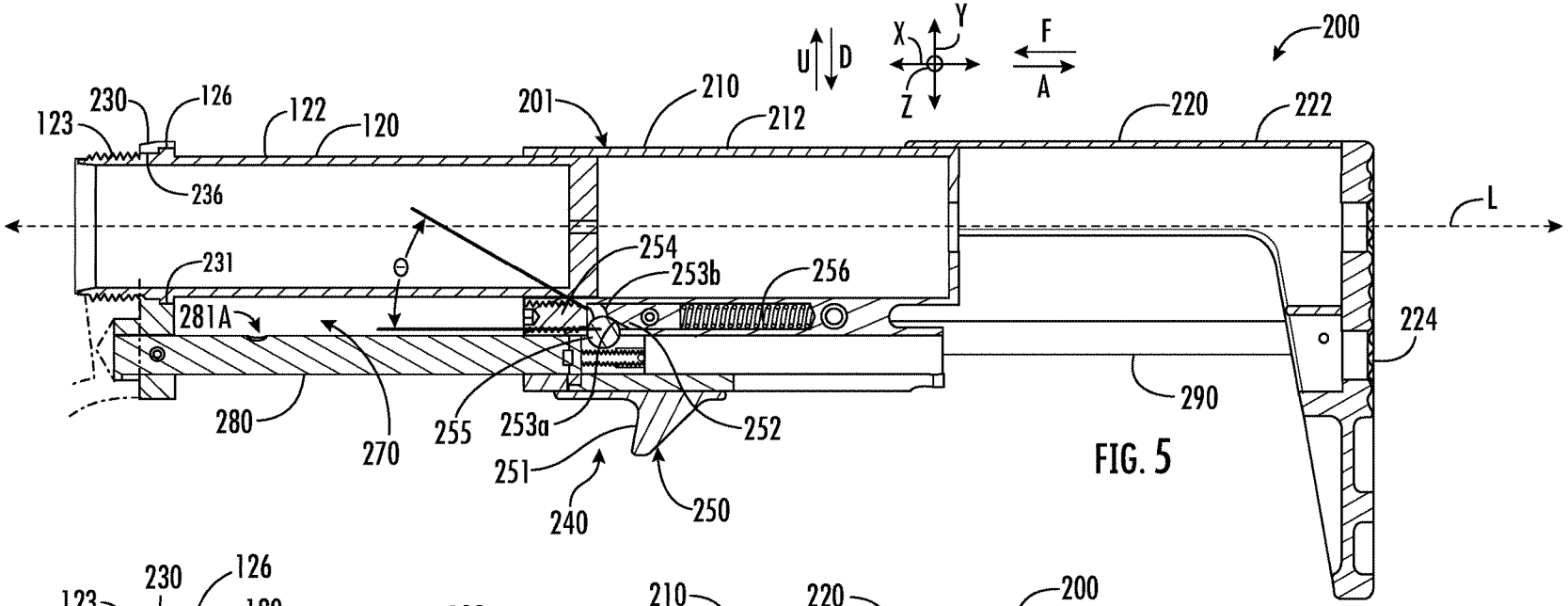

FIG. 5 provides a cross-sectional, side view of the stock of the firearm of FIG. 1 in a fully extended state, in accordance with an example embodiment.

Figure 6:
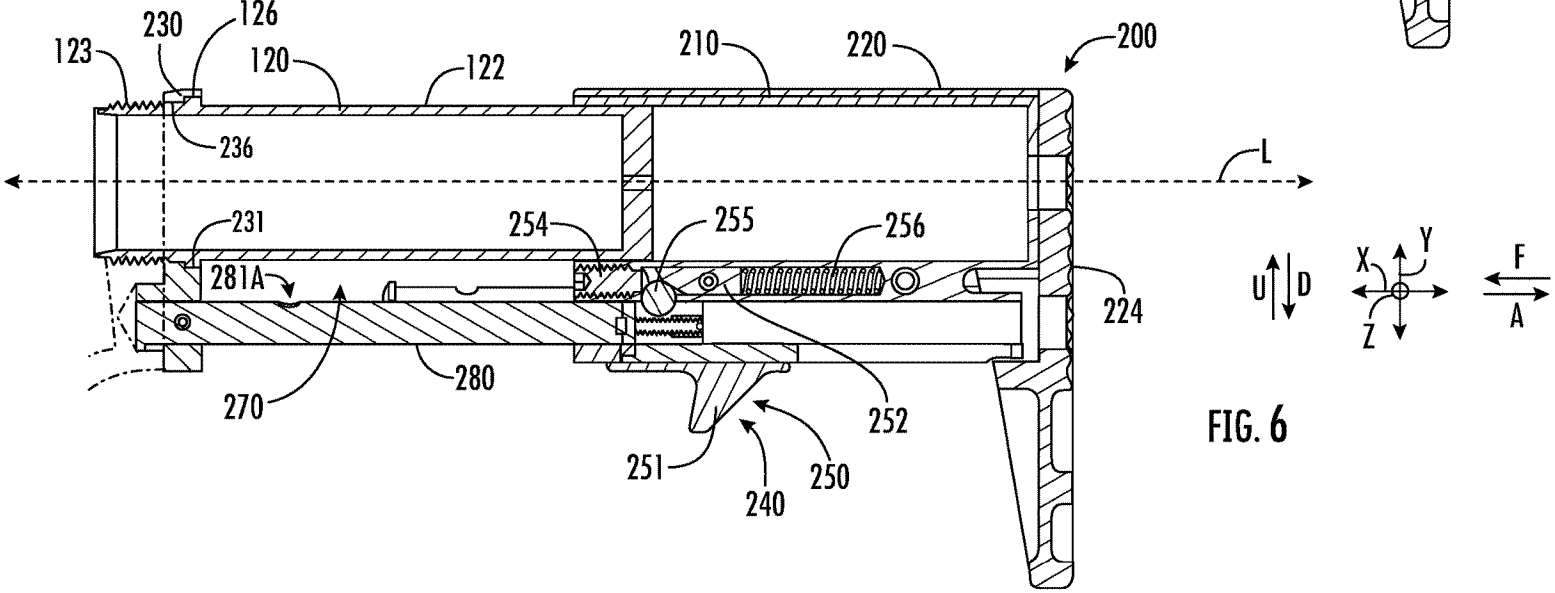

FIG. 6 provides a cross-sectional, side view of the stock of the firearm of FIG. 1 in a partially extended state, in accordance with an example embodiment.

Figure 7:
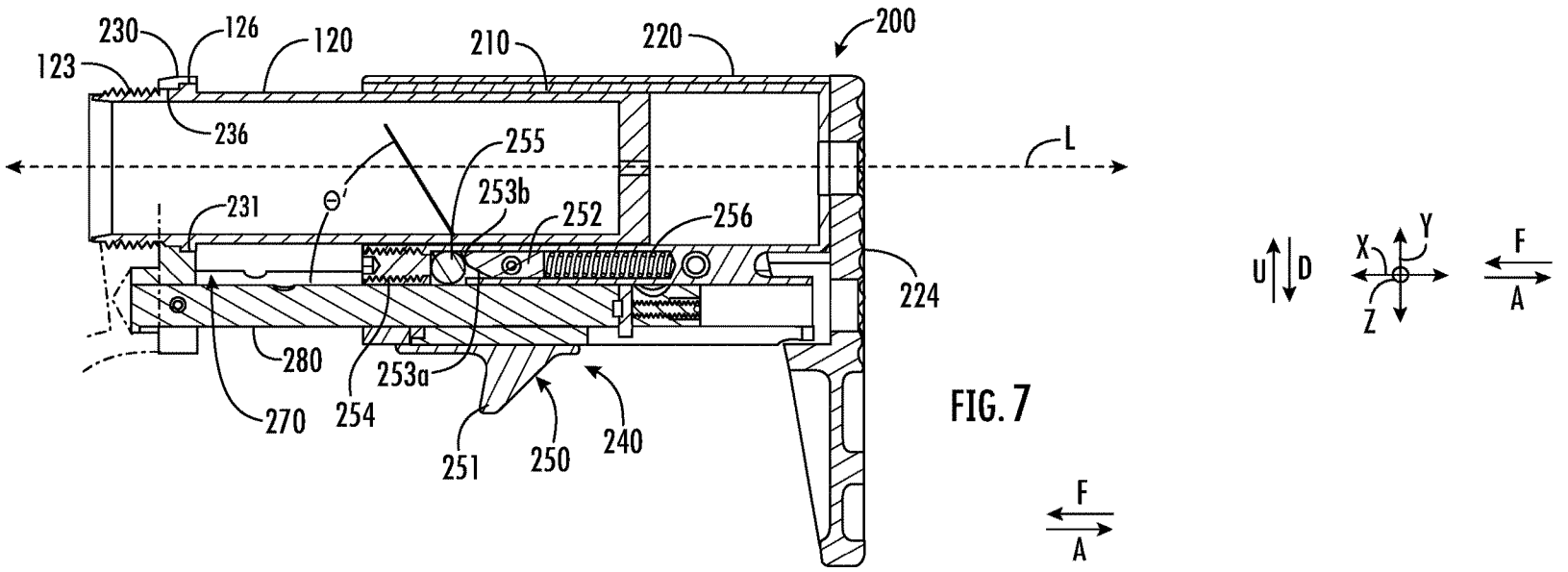

FIG. 7 provides a cross-sectional, side view of the stock of the firearm of FIG. 1 in a partially extended state, in accordance with an example embodiment.

Figure 8:
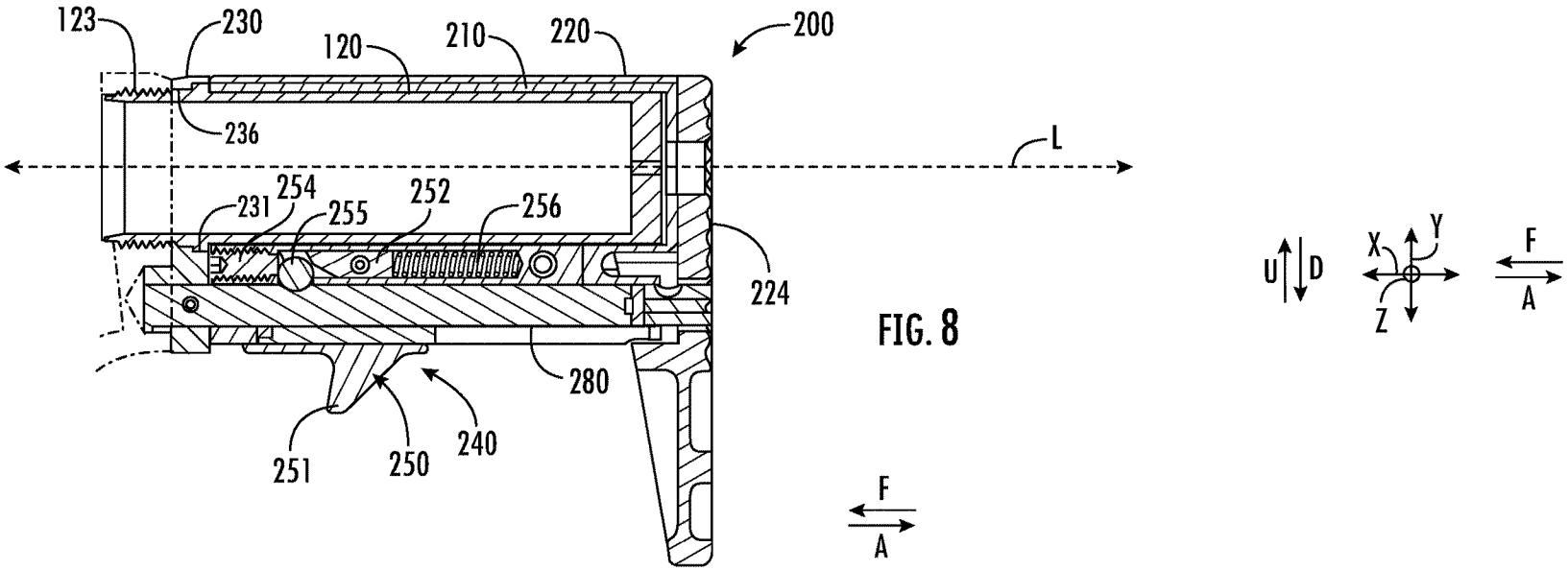

FIG. 8 provides a cross-sectional, side view of the stock of the firearm of FIG. 1 in a fully collapsed state, in accordance with an example embodiment.

Figure 9A:
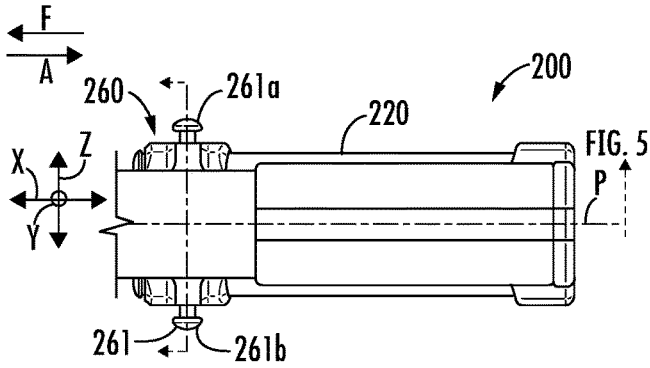

FIG. 9A provides a top view of the stock of the firearm of FIG. 1, in accordance with an example embodiment.

Figure 9B:
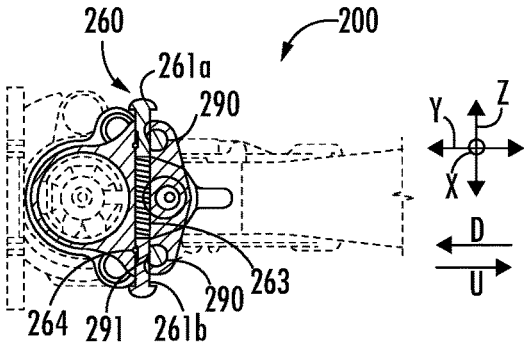

FIG. 9B provides a cross-sectional, side view of the stock of the firearm of FIG. 1, in accordance with an example embodiment.

Figure 10A:
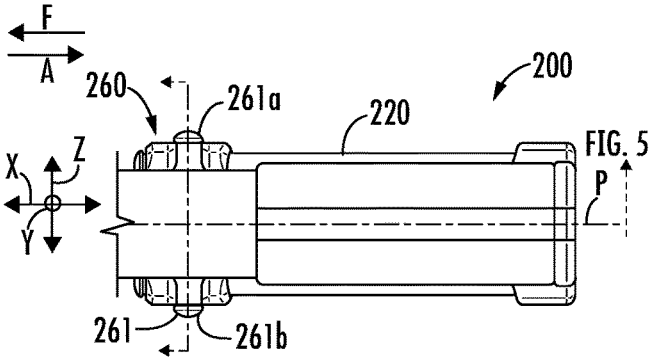

FIG. 10A provides a top view of the stock of the firearm of FIG. 1, in accordance with an example embodiment.

Figure 10B:
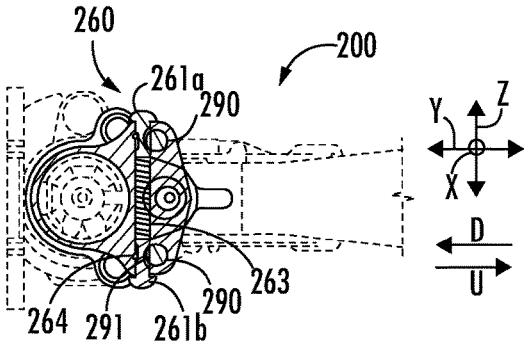

FIG. 10B provides a cross-sectional, side view of the stock of the firearm of FIG. 1, in accordance with an example embodiment.

Figure 11A:
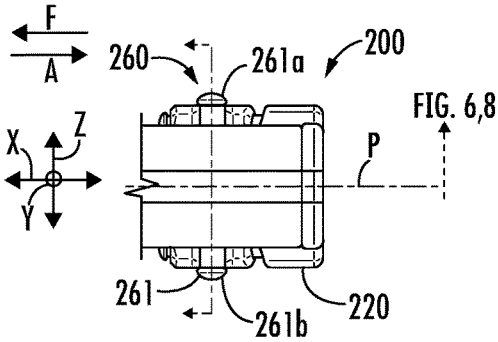

FIG. 11A provides a top view of the stock of the firearm of FIG. 1, in accordance with an example embodiment.

Figure 11B:
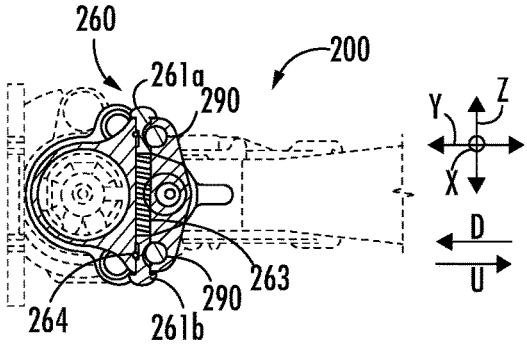

FIG. 11B provides a cross-sectional, side view of the stock of the firearm of FIG. 1, in accordance with an example embodiment.

Figure 12:
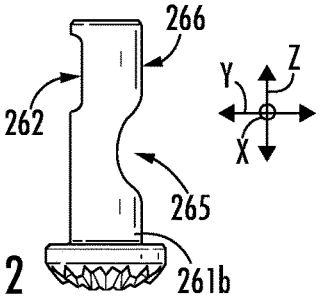

FIG. 12 provides a side view of a movable component of the stock of the firearm of FIG. 1, in accordance with an example embodiment.

Figure 13:
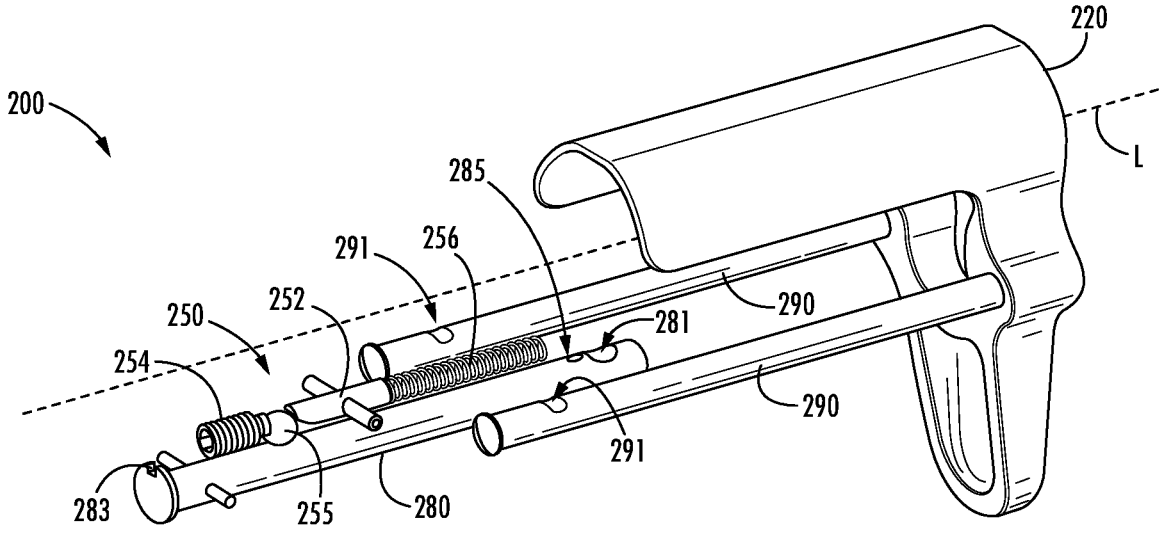

FIG. 13 provides a partial, perspective view of the stock of the firearm of FIG. 1, in accordance with an example embodiment.

Figure 14:
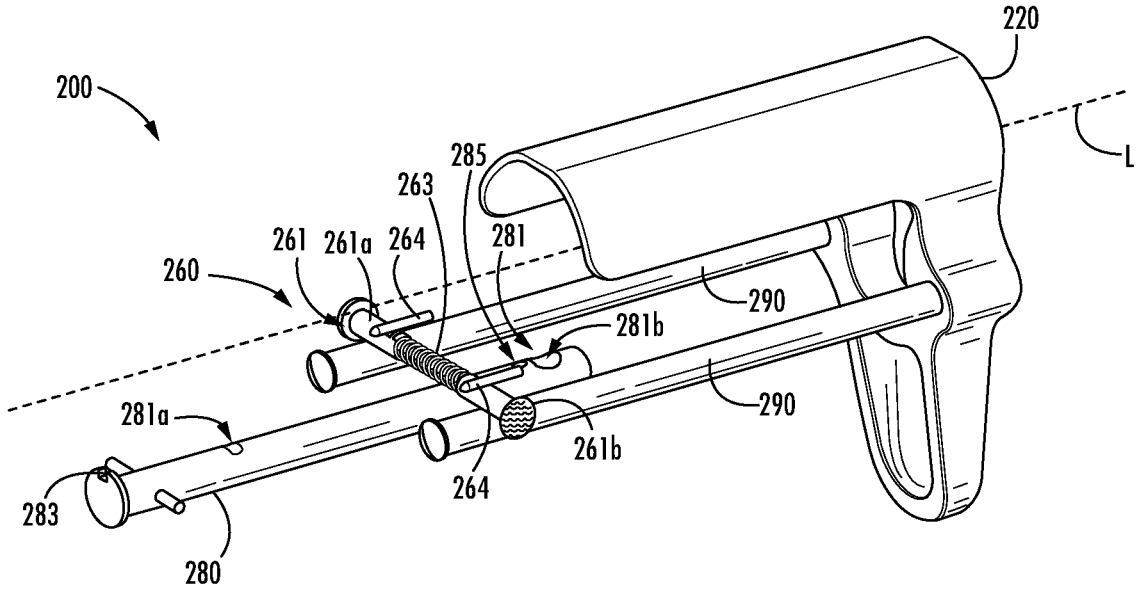

FIG. 14 provides a partial, perspective view of the stock of the firearm of FIG. 1, in accordance with an example embodiment.

Figure 15:
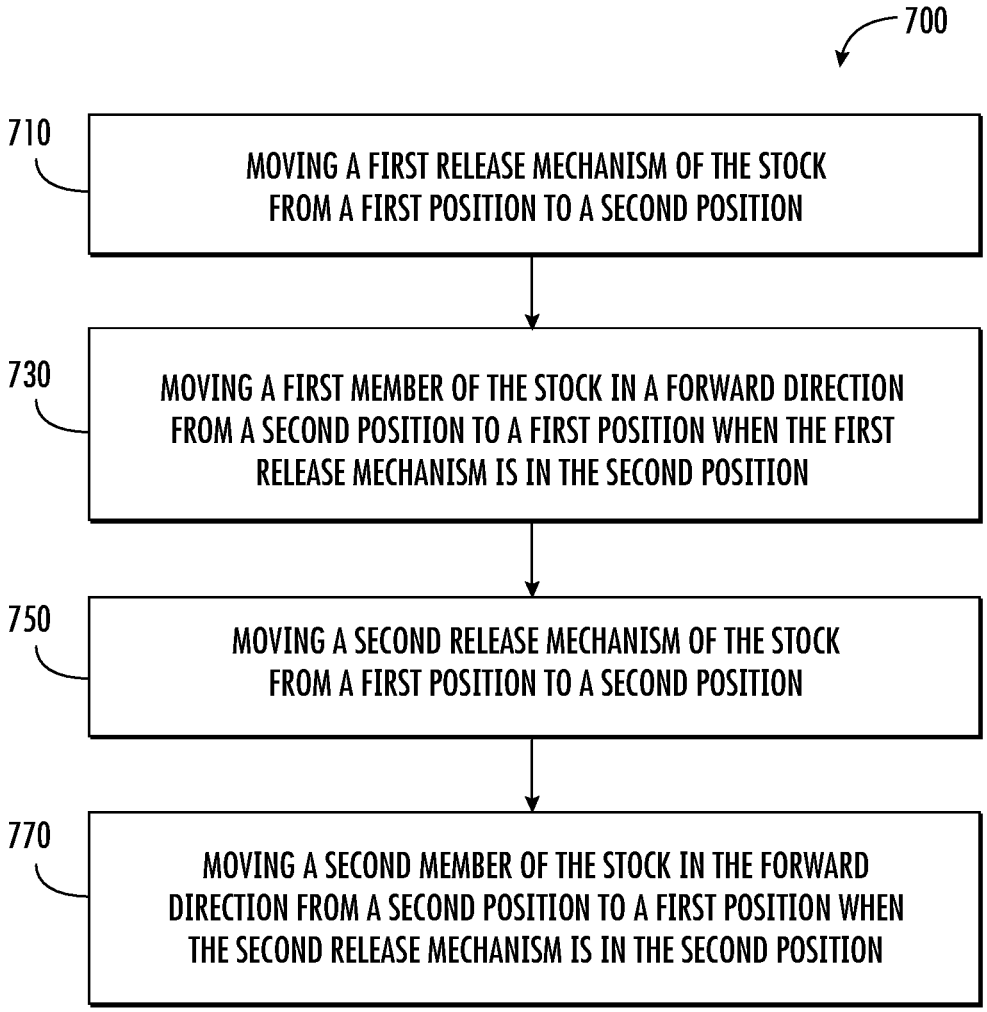

FIG. 15 provides a flowchart for a method of transitioning a stock of a firearm from a fully extended state to a fully collapsed state, in accordance with an example embodiment.

DETAILED DESCRIPTION

One or more embodiments are now more fully described with reference to the accompanying drawings, wherein like reference numerals are used to refer to like elements throughout and in which some, but not all embodiments of the inventions are shown. In the following description, for purposes of explanation, numerous specific details are set forth in order to provide a thorough understanding of the various embodiments. It is evident, however, that the various embodiments can be practiced without these specific details. It should be understood that some, but not all embodiments are shown and described herein. Indeed, the embodiments may be embodied in many different forms, and accordingly this disclosure should not be construed as limited to the embodiments set forth herein. Rather, these embodiments are provided so that this disclosure will satisfy applicable legal requirements.

As used herein, the term "exemplary" and variants thereof mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. In addition, while a particular feature may be disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

As used herein, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As used herein, the terms "coupled," "fixed," "attached to," and the like refer to both direct coupling, fixing, or attaching, as well as indirect coupling, fixing, or attaching through one or more intermediate components or features, unless otherwise specified herein.

As used herein, the term "positioned directly on" refers to a first component being positioned on a second component such that they make contact. Similarly, as used herein, the term "positioned directly between" refers to a first component being positioned between a second component and a third component such that the first component makes contact with both the second component and the third component. In contrast, a first component that is "positioned between" a second component and a third component may or may not have contact with the second component and the third component. Additionally, a first component that is "positioned between" a second component and a third component is positioned such that there may be other intervening components between the second component and the third component other than the first component.

Referring now to FIG. 1 and FIG. 2, side views of a firearm 100 are provided, in accordance with an example embodiment. The firearm 100 may be configured as a rifle. For example, various embodiments of the firearm 100 discussed herein may include any firearm capable of utilizing a collapsible stock 200, including but not limited to semi-automatic rifles, bolt-action rifles, automatic rifles, and/or shotguns. For example, some embodiments of the firearm 100 may be an AR-15 platform rifle, AR-10 platform rifle, or other similar rifle. As will be discussed further, the firearm 100 may include a stock 200. FIG. 1 provides a side view of the firearm 100 with the stock 200 in a fully collapsed state and FIG. 2 provides a side view of the firearm 100 with the stock 200 in a fully extended state, in accordance with an example embodiment.

The firearm 100 may include a main body 110. The main body 110 may include an upper receiver 115. A barrel may be coupled to the upper receiver 115. The barrel may be configured to allow a projectile, such as a bullet or a slug, to travel through it when the firearm 100 is fired. The main body 110 of the firearm 100 may define a longitudinal direction X, a vertical direction Y that is orthogonal to the longitudinal direction X, and a lateral direction Z that is orthogonal to the longitudinal direction X and the vertical direction Y. The firearm 100 may define a longitudinal axis L that extends through the barrel that is coupled to the upper receiver 115 along the longitudinal direction X. The main body 110 of the firearm 100 may define a forward direction F and an aft direction A that extend in the longitudinal direction X. The main body 110 of the firearm 100 may define an upward direction U and a downward direction D that extend in the vertical direction Y.

The main body 110 of the firearm 100 may include a lower receiver 111 that is coupled to the upper receiver 115. For example, the lower receiver 111 may be coupled to the upper receiver 115 and positioned downward from the upper receiver 115. The firearm 100 may include a trigger group 117 that is housed, at least partially, within the lower receiver 111. The trigger group 117 may be configured to initiate the firing of the firearm 100, which may cause the projectile to travel through the barrel that is coupled to the upper receiver 115.

The firearm 100 may include a tube 120 (FIG. 2). The tube 120 may be coupled, directly or indirectly, to the main body 110 of the firearm 100. For example, the tube 120 may be coupled, directly or indirectly, to the lower receiver 111 of the main body 110 of the firearm 100 and positioned aft of the lower receiver 111 and aft of the upper receiver 115. The tube 120 may include one or more threads 123 that are configured to mate with corresponding one or more threads of the main body 110 of the firearm 100, such as one or more threads of the lower receiver 111. The tube 120 may be configured as a buffer tube that is configured to house a recoil buffer mechanism (not depicted), which may include a spring and a weighted part, such as a recoil buffer. The tube 120 may be generally cylindrically shaped. In some embodiments, the tube 120 may be shaped differently and/or include features, such as external features, that deviate from the cylindrical shape.

As discussed, the firearm 100 may include a stock 200. The stock 200 may be positioned at least partially aft of the main body 110 of the firearm 100. The stock 200 may include a mount 230. The mount 230 may be configured to be coupled, directly or indirectly, to the main body 110 of the firearm 100, such as coupled, directly or indirectly, to the lower receiver 111. For example, the mount 230 may be configured to be rigidly to the main body 110 of the firearm 100 such that the mount 230 is prevented from moving relative to the main body 110 of the firearm 100. Stated differently, the mount 230, once coupled to the main body 110 of the firearm 100, is configured to be stationary relative to the main body 110 of the firearm 100.

Referring now to FIG. 3 and FIG. 4, a perspective view of the firearm 100 of FIG. 1 is provided with the stock 200 and tube 120 disconnected (FIG. 3) and a partial, perspective view of the stock 200 of the firearm 100 of FIG. 1 is provided (FIG. 4), in accordance with an example embodiment. In various examples, and as depicted in these views, the mount 230 may include an orifice 231 to receive the tube 120. In various examples, the orifice 231 of the mount 230 is configured to allow the tube 120 to rotate within the orifice 231. To couple the mount 230 of the stock 200 to the main body 110 of the firearm 100, the one or more threads 123 of the tube 120 may be mated with the one or more threads of the main body 110 by rotating the tube 120 within the mount 230.

In various examples, the mount 230 may include one or more sling features 124. Each sling feature 124 may be configured to allow a sling (not depicted) to be couple thereto. In various examples, the mount 230 does not include sling features 124.

In various examples, the stock 200 does not include the mount 230 as depicted in FIG. 3 and FIG. 4. Instead, the mount 230 is configured as an end plate that, in conjunction with a castellated nut ("castle nut"), rigidly couple the tube 120 to the main body 110 of the firearm 100. When the mount 230 is configured as an end plate, the end plate and/or the castle nut, once coupled to the main body 110 of the firearm 100, is prevented from moving relative to the main body 110 of the firearm 100.

Referring back to FIG. 1 and FIG. 2, the stock 200 may include a first member 210 that is configured to move along the longitudinal axis L relative to the mount 230. For example, the first member 210 may be configured to be in a first position, as depicted in FIG. 1, and in a second position, as depicted in FIG. 2. When the first member 210 is in the first position, the first member 210 may be closer to the main body 110 of the firearm 100 than when the first member 210 is in the second position. For example, and as depicted in FIG. 1, the first member 210, when in the first position, may be adjacent to the mount 230 and, in some examples, may abut the mount 230. Also, or alternatively, when the first member 210 is in the first position, the first member 210 may have a substantially similar position to the tube 120 along the longitudinal axis L. For example, when the first member 210 is in the first position, the first member 210 may, at least partially, circumferentially surround at least eighty percent, such as at least ninety percent, of a longitudinal length of the tube 120. Stated differently, when the first member 210 is in the first position, at least eighty percent, such as at least ninety percent, of the first member 210 may be nested over at least eighty percent, such as at least ninety percent, of the tube 120.

When the first member 210 is in the second position, as depicted in FIG. 2, the first member 210 may be spaced from the mount 230 such that the first member 210 does not abut the mount 230. Also, or alternatively, when the first member 210 is in the second position, the first member 210 may only have a small portion that has the same position along the longitudinal axis L as the tube 120. For example, when the first member 210 is in the second position, the first member 210 may, at least partially, circumferentially surround less than twenty percent, such as less than ten percent, of a longitudinal length of the tube 120. Stated differently, when the first member 210 is in the second position, less than twenty percent, such as less than ten percent, of the first member 210 may be nested over less than twenty percent, such as less than ten percent, of the tube 120. In some embodiments, the aft end of the tube 120 and the fore end of the first member 210 may be at the same position in an instance in which the first member 210 is in the second position, or a gap may be defined between the two in an instance in which the first member 210 is in the second position.

The stock 200 may include a second member 220 that is configured to move along the longitudinal axis L relative to the mount 230 and/or the first member 210. For example, the second member 220 may be configured to be in a first position, as depicted in FIG. 1, and in a second position, as depicted in FIG. 2. When the second member 220 is in the first position, the second member 220 may be closer to the main body 110 of the firearm 100 than when the second member 220 is in the second position. Also, or alternatively, when the second member 220 is in the first position, the second member 220 may have a substantially similar position to the first member 210 along the longitudinal axis L. For example, when the second member 220 is in the first position, the second member 220 may, at least partially, circumferentially surround at least eighty percent, such as at least ninety percent, of a longitudinal length of the first member 210. Stated differently, when the second member 220 is in the first position, at least eighty percent, such as at least ninety percent, of the second member 220 may be nested over at least eighty percent, such as at least ninety percent, of the first member 210.

When the second member 220 is in the second position, as depicted in FIG. 2, the second member 220 may only have a small portion that has the same position along the longitudinal axis L as the first member 210. For example, when the second member 220 is in the second position, the second member 220 may, at least partially, circumferentially surround less than twenty percent, such as less than ten percent, of a longitudinal length of the first member 210. Stated differently, when the second member 220 is in the second position, less than twenty percent, such as less than ten percent, of the second member 220 may be nested over less than twenty percent, such as less than ten percent, of the first member 210. In some embodiments, the fore end of the second member 220 and the aft end of the first member 210 may be at the same position in an instance in which the second member 220 is in the second position, or a gap may be defined between the first member 210 and the second member 220 in an instance in which the second member 220 is in the second position.

In some embodiments, the tube 120 and the first member 210, on the one hand, and the first member 210 and the second member 220, on the other hand, may each remain at least partially overlapping (e.g., in a same position) along the longitudinal axis L in both the first position (e.g., the collapsed position) and the second position (e.g., the extended position), which may facilitate a smooth cheek rest surface 201 for the user. In some embodiments, the stock may define a telescoping structure, whereby the tube 120, the first member 210, and the second member 220 nest together in the collapsed position, with the first member 210 disposed radially between the tube 120 and the second member 220. The first position may define a greater portion of each of the tube 120, first member 210, and second member 220 overlapping than the second position. In this manner, the aforementioned telescoping stock 200 may provide a greater range of expansion and more compact collapse process than a traditional collapsible stock.

The stock 200 may include a first release mechanism 250 that is configured to be in a first position and in a second position. As will be discussed further, when the first release mechanism 250 is in the first position, the release mechanism may be configured to prevent a movement of the first member 210 along the longitudinal axis L relative to the mount 230. When the first release mechanism 250 is in the second position, the first release mechanism 250 may be configured to allow a movement of the first member 210 along the longitudinal axis relative to the mount 230.

The stock 200 may include a forward guide rod 280 that may extend substantially parallel to (e.g., within two degrees, such as within one degree and/or within other manufacturing and/or engineering design tolerances) the longitudinal axis L. The forward guide rod 280 may be slidingly engaged with the first release mechanism 250 and/or the first member 210. The forward guide rod 280 may be rigidly coupled to, or integral with, the main body 110 of the firearm 100 and/or to the mount 230 (e.g., via set screw, pin, or the like). Referring again briefly to FIG. 3 and FIG. 4, the forward guide rod 280 may extend through the mount 230 and protrude from the aft surface of the mount 230. Also, or alternatively, the forward guide rod 280 may extend into a cavity 112 in the main body 110 of the firearm 100. The forward guide rod 280 may include one or more alignment features 283 that each mate with a corresponding alignment feature that is associated with the cavity 112 of the main body 110 of the firearm 100. The alignment feature 283 may ensure proper alignment of the forward guide rod 280 in relation to the main body 110 of the firearm 100. For example, the alignment feature 283 may ensure that the forward guide rod 280 is rotated such that one or more depressions 281 (FIGS. 13 and 14) of the forward guide rod 280 and/or an orifice 285 (FIGS. 13 and 14) for a limiting pin is in the proper position (e.g., facing the tube 120) when the forward guide rod 280 is being coupled to the main body 110 of the firearm 100. Even though in the examples of FIGS. 1-4, the stock 200 includes only one forward guide rod 280, in various other examples, the stock 200 includes two, three, four or more forward guide rods 280.

Referring again to FIG. 1 and FIG. 2, the stock 200 may include a second release mechanism 260 that is configured to be in a first position and in a second position. As will be discussed further, when the second release mechanism 260 is in the first position, the second release mechanism 260 may be configured to prevent a movement of the second member 220 along the longitudinal axis L relative to the first member 210. When the second release mechanism 260 is in the second position, the release mechanism may be configured to allow a movement of the second member 220 along the longitudinal axis relative to the first member 210.

The stock 200 may include a pair of aft guide rods 290 that may each extend substantially parallel to (e.g., within two degrees, such as within one degree, and/or within other manufacturing and/or engineering design tolerances) the longitudinal axis L. In various examples, the stock 200 includes one, three, four or more aft guide rods 290. Each of the pair of aft guide rods 290 may be slidingly engaged with the second release mechanism 260 and/or the first member 210. Each aft guide rod 290 may be rigidly coupled to, or integral with, the second member 220. Each of the pair of aft guide rods 290 may be configured to move in the longitudinal direction with the second member 220 as the second member 220 moves from its first position to its second position, and vice-versa.

In various examples, and as depicted in FIG. 1 and FIG. 2, the first release mechanism 250 and the second release mechanism 260 are integral with the first member 210. For example, the stock 200 may include a release mechanism assembly 240 that includes the first release mechanism 250 and the second release mechanism 260. In various examples, the first release mechanism 250 and the second release mechanism 260 are coupled, directly or indirectly, with the first member 210. The first release mechanism 250 and the second release mechanism 260 may be configured to move with the first member 210 when the first member 210 moves from its first position to its second position, and vice-versa.

In some embodiments, the first release mechanism 250 and/or the second release mechanism 260 are not integral with or coupled to the first member 210 and/or include portions that are movable relative to the first member 210. For example, the first release mechanism 250 may be integral with or coupled to the mount 230 or the tube 120, and the second release mechanism 260 may be integral with or coupled to the second member 220.

Referring now to FIGS. 5-8, cross-sectional, side views of the stock 200 of the firearm 100 of FIG. 1 and FIG. 2 are provided, in accordance with an example embodiment. More specifically, FIGS. 5-8 provide cross-sectional views taken along a plane P (FIGS. 9A, 10A, 11A) that substantially bisects the stock 200 and extends in the longitudinal direction X and in the vertical direction Y. FIG. 5 provides a view of the stock 200 in a fully extended state (e.g., the first member 210 in a second position relative to the mounting plate and the second member 220 in a second position relative to the first member 210), FIG. 6 provides a view of the stock 200 in a partially extended state (e.g., first member 210 in a second position relative to the mounting plate and the second member 220 in a first position relative to the first member 210), FIG. 7 provides a view of the stock 200 between a partially extended state and a fully collapsed state, and FIG. 8 provides a view of the stock 200 in the fully collapsed state (e.g., first member 210 in a first position relative to the mounting plate and the second member 220 in a first position relative to the mounting plate). Also, FIGS. 5, 6, and 8 provides a view of the first release mechanism 250 in the first position that may prevent the movement of the first member 210 along the longitudinal axis relative to the mount 230 and FIG. 7 provides a view of the first release mechanism 250 in the second position that may allow the movement of the first member 210 along the longitudinal axis relative to the mount 230.

In various examples, and as depicted in FIGS. 5-8, the tube 120 may include a shoulder 126. The shoulder 126 may extend radially outward from the body of the tube 120. The shoulder 126 of the tube 120 may be configured to mate with a corresponding indentation on an inner portion of the mount 230. The mount 230 may include a shoulder 236. The shoulder 236 of the mount 230 may extend radially inward from the body of the mount 230. The shoulder 236 of the mount 230 may be configured to mate with a corresponding indentation on an outer portion of the tube 120. In various examples, and as depicted in FIGS. 5-8, the shoulder 236 of the mount 230 is positioned forward of the shoulder 126 of the tube 120. This configuration may prevent the movement of the mount 230 in the aft direction A in relation to the tube 120 and/or the main body 110 of the firearm 100.

In various examples, and as depicted in FIGS. 5-8, the first release mechanism 250 may include a movable component 251. When the movable component 251 is in the first position, the movable component 251 may be configured so that it may be moved in the aft direction A to the second position when a force is exerted on it in the aft direction A (e.g., a force exerted on it from an individual's finger). In various examples, and as depicted in FIGS. 5-8, the movable component 251 may be trigger-shaped. The movable component 251 may have any shape that would allow an aft force to be exerted on it, such as rectangular cuboid shaped.

The first release mechanism 250 may include a wedge member 252. The movable component 251 may be rigidly coupled, directly or indirectly, to the wedge member 252. For example, the movable component 251 may be coupled to the wedge member 252 such that the wedge member 252 moves aft, or forward, in unison with the movable component 251. The wedge member 252 may include a first surface 253*a* and a second surface 253*b*. The first surface 253*a* may be adjacent to the second surface 253*b* and positioned downward from the second surface 253*b*. The first surface 253*a* may define a first angle Θ (FIG. 5) relative to a plane defined by the longitudinal direction X and the lateral direction Z. The first angle Θ may be at least at least twenty degrees and up to forty degrees, such as at least twenty-five degrees and up to thirty-five degrees, such as approximately thirty degrees (e.g., within manufacturing and/or engineering design tolerances). The second surface 253*b* may define a second angle Θ' (FIG. 7) relative to the plane defined by the longitudinal direction X and the lateral direction Z. The second angle Θ' may be steeper (e.g., greater relative to the depicted measurements) than the first angle Θ. The second angle Θ' may be at least fifty degrees and up to seventy degrees, such as at least fifty-five degrees and up to sixty-five degrees, such as approximately sixty degrees (e.g., within manufacturing and/or engineering design tolerances).

The first release mechanism 250 may include a biasing device 256. The wedge member 252 may be coupled, directly or indirectly to the biasing device 256, which may be configured as a spring. The biasing device 256 may extend in the longitudinal direction X and be configured to exert a force on the wedge member 252 in the forward direction F. Stated differently, the biasing device 256 may be configured to bias the wedge member 252 in the forward direction F.

The first release mechanism 250 may include an abutment member 254. The abutment member 254 may be positioned forward of the wedge member 252 and forward of the biasing device 256. The wedge member 252 may be positioned between the abutment member 254 and the biasing device 256 along the longitudinal direction X. The abutment member 254 may be configured to be coupled to or integral with the first member 210 such that the abutment member 254 moves with the first member 210. In various examples, and as depicted in FIGS. 5-8, the abutment member 254 is configured as a screw, such as a set screw, such as a dog point set screw. In various examples, the abutment member 254 may be configured as a plug or may be integral with the first member 210.

The first release mechanism 250 may include a deflectable component 255. As will be discussed further, the deflectable component 255 may be configured to roll, translate, or otherwise be displaced in response to application of a force thereto. In various examples, the deflectable component 255 is spherical, as depicted in FIG. 13. The deflectable component 255 can, in some examples, be cylindrically-shaped.

As discussed, the first member 210 is configured to move from a first position to a second position, and vice-versa, relative to the mount 230. Also as discussed, the first release mechanism 250 is configured to be in a first position that prevents the movement of the first member 210 relative to the mount 230 and configured to be in a second position that allows the movement of the first member 210 relative to the mount 230. The first release mechanism 250 may be configurable to the first position in both the first position of the first member 210 and the second position of the first member 210, such that the first member 210 may be rigidly held relative to the mount 230 in both positions. When the first release mechanism 250 is in the first position, as depicted in FIGS. 5, 6, and 8, a first force in the forward direction F exerted on the wedge member 252 by, for example, the biasing device 256, is greater than a second force in the aft direction A, if any, exerted on the wedge member 252 (e.g., a force in the aft direction A exerted on the wedge member 252 by an individual's finger on the movable component 251). When the first force in the forward direction F is greater than a second force in the aft direction A, the wedge member 252 is moved or maintained in the forward direction F to a forwardmost position. The forwardmost position of the wedge member 252 may cause the first surface 253*a* and/or the second surface 253*b* of the wedge member 252 to exert a force on the deflectable component 255 at least partially in the downward direction D.

Referring briefly to FIG. 13 and FIG. 14, the forward guide rod 280 may include one or more depressions 281. In various examples, and as depicted in FIG. 13 and FIG. 14, the forward guide rod 280 includes two depressions 281, a first depression 281*a* and a second depression 281*b*. In various examples, the forward guide rod 280 includes one, three, four or more depressions 281. Each of the one or more depressions 281 may be sized to allow the deflectable component 255 to fit at least partially within the one or more depressions 281. In various examples, at least one of the one or more depressions 281 is larger in size than another one of the one or more depressions 281. For example, and as depicted in FIG. 14, the second depression 281*b* is larger than the first depression 281*a*. In various examples, each of the at least one of the one or more depressions 281 are the same size.

Referring back to FIGS. 5, 6, 8, the deflectable component 255 may be configured to be positioned at least partially within the one or more depressions 281 of the forward guide rod 280. For example, the force exerted by the wedge member 252 (e.g., the force exerted by the first surface 253*a* of the wedge member 252) at least partially in the downward direction D may force the deflectable component 255 into the respective one or more depression 281 and/or may prevent the deflectable component 255 from leaving the respective one or more depression 281 of the forward guide rod 280. The prevention of the deflectable component 255 from leaving the respective one or more depression 281 may prevent the movement of the first member 210 along the longitudinal axis relative to the mount 230 and relative to the forward guide rod 280. Therefore, when the release mechanism is in the first position and the deflectable component 255 is within one of the one or more depressions 281, as depicted in FIGS. 5-8, the release mechanism may be configured to prevent a movement of the first member 210 along the longitudinal axis relative to the mount 230.

The deflectable component 255 may be configured to roll or otherwise travel along a surface of the forward guide rod 280 in the longitudinal direction X. For example, the deflectable component 255 may be configured to travel from one of the one or more depressions 281 to another one of the one or more depressions 281. In various examples, and as depicted in FIGS. 5-8, the deflectable component 255 is configured to travel from the second depression 281*b* to the first depression 281*a* when the first member 210 is moved from the second position to the first position, and vice versa.

Referring now to FIG. 7, which provides a view of the first release mechanism 250 in the second position, the first release mechanism 250, when in the second position, may allow the deflectable component 255 to move from one of the one or more depressions 281*a*, 281*b* to another one of the one or more depressions 281*a*, 281*b*, which may allow the movement of the first member 210 along the longitudinal axis relative to the mount 230. For example, the first release mechanism 250 may be moved to the second position by moving the movable component 251 in the aft direction A by, for example, an individual's finger. Moving the movable component 251 in the aft direction A may compress, or further compress, the biasing device 256, which moves the wedge member 252 in the aft direction A.

When the deflectable component 255 is in one of the one or more depressions 281 and the first release mechanism 250 is in the second position, the deflectable component 255 may be allowed to leave (e.g., not prevented from leaving) the respective depression 281. For example, when the deflectable component 255 is in one of the one or more depressions 281, an individual may pull the movable component 251 in the aft direction A, which moves the first release mechanism 250 to the second position, and, at the same time, the individual may move the first member 210 in the longitudinal direction X to a desired position, such as the first position or the second position. The force exerted by the individual moving the first member 210 in the longitudinal direction X, exerts a force in the longitudinal direction X on the deflectable component 255 by the abutment member 254 or the wedge member 252, which causes the deflectable component 255 to move out of the respective one or more depression 281 and, subsequently, travel along the forward guide rod 280 within a channel 270 defined by the forward guide rod 280 and the first member 210.

As discussed, the wedge member 252 may include a first surface 253*a* that defines a first angle Θ (FIG. 5) and a second surface 253*b* that defines a second angle Q' (FIG. 7) that is greater than the first angle Q. Notably, in at least the example of FIGS. 5-8, the first release mechanism 250 is configured such that the deflectable component 255 makes contact with the first surface 253*a* of the wedge member 252 when the deflectable component 255 is positioned at least partially within one of the one or more depressions 281 and further configured such that the deflectable component 255 makes contact with the second surface 253*b* of the wedge member 252 when the deflectable component 255 is not positioned within one of the one or more depressions 281 (e.g., when the deflectable component 255 is moving along the forward guide rod 280).

As will be appreciated, because the first angle Θ is less than the second angle Θ', with respect to a plane defined by the longitudinal direction X and the lateral direction Z relative to the depicted measurement directions, when the first member 210 is moved forward, the second surface 253*b* of the wedge member 252 would exert a greater force in the forward direction F than the first surface 253*a* of the wedge member 252. Similarly, when the first member 210 is moved forward, the first surface 253*a* of the wedge member 252 would exert a greater force in the downward direction D than the second surface 253*b* of the wedge member 252. Therefore, having a wedge member 252 that includes a first surface 253*a* that defines a first angle θ (FIG. 5) that is less than a second angle Θ' of a second surface 253*b*, the second surface 253*b* being positioned adjacent to and upward from the first surface 253*a*, has various benefits in fine tuning the desired force application at each stage of actuation of the first release mechanism 250 and/or control of the first member 210.

For example, the second angle Θ' of the second surface 253*b* may allow the deflectable component 255 to more easily move along the forward guide member than if the second surface 253*b* had a second angle Θ' that was less than or equal to the first member 210 (e.g., less than fifty degrees). This may result in a more tactically smooth transition when the first member 210 moves from the second position to the first position. The more tactically smooth transition may increase performance of the stock 200 for an individual that is moving the first member 210 from the second position to the first position. Also, the lesser angle of the first surface 253*a* may increase the ability of the wedge member 252 to prevent the deflectable component 255 from leaving a respective one or more depression 281 than if the first surface 253*a* had a first angle that was greater than or equal to the first angle (e.g., greater than forty degrees).

As discussed, the second depression 281*b* of the forward guide rod 280 may be larger than the first depression 281*a* of the forward guide rod 280. In various examples, and as depicted in FIG. 5-6, the second depression 281*b* may be sized such that at least one-third, such as at least one-half of the diameter of the deflectable component 255 fits within the second depression 281*b*. In various examples, and as depicted in FIG. 8, the first depression 281*a* may be sized such that less than one-third, such as less than one-fourth, such as less than one-sixth, such as approximately one-eighth (e.g., within manufacturing and/or engineering design tolerances) of the diameter of the deflectable component 255 fits within the first depression 281*a*. As will be appreciated, while the stock 200 is in use and the first member 210 is in the second position, a relatively large force in the forward direction F may be exerted onto the first member 210 by, for example, the shoulder of an individual and/or the counter-force caused by a recoil of the firearm 100. Therefore, it may be beneficial to have the second depression 281*b* sized such that at least one-third, such as at least one-half of the diameter of the deflectable component 255 fits within the second depression 281*b* to prevent undesirable movement of the first member 210 in the forward direction F.

In some embodiments, it may be beneficial to allow the first member 210 to move from the first position in the aft direction A with a relatively low amount of force from, for example, an individual. As such, having a first depression 281*a* that is sized such that less than one-third, such as less than one-fourth, such as less than one-sixth, such as approximately one-eighth of the diameter of the deflectable component 255 fits within the first depression 281*a* may be beneficial. In various examples, the first depression 281*a* is sized to lightly prevent undesired movement of the first member 210 from the first position in the aft direction A from, for example, tilting the stock 200, but allows the movement of the first member 210 from the first position in the aft direction A with a relatively low amount of force from an individual pulling back on the first member 210 in the aft direction A and without requiring interaction with the first release mechanism 250. Stated differently, the first depression 281*a* may be sized to maintain the position of the first member 210 in the first position without "locking" the first member 210 in the first position. In some embodiments, the first depression 281*a* may be structured to require user interaction with the first release mechanism 250 to release the first member 210 from the first position. In some embodiments, one or both of the respective depressions 281*a*, 281*b* may be sized greater than or equal to half the diameter of the deflectable component 255 in an instance in which they are configured to lock the position of the stock 200 (e.g., requiring user engagement with a release mechanism to change the configuration of the stock), and one or both of the respective depressions 281*a,b* may be sized less than half the diameter of the deflectable component 255 in an instance in which they are configured to lightly restrict the position of the stock 200 while not requiring, although not preventing, user engagement of the first release mechanism 250 to change the stock configuration.

Referring now to FIGS. 9A-11B, cross-sectional views of the stock 200 of the firearm 100 of FIG. 1 and FIG. 2 are provided, in accordance with an example embodiment. More specifically, FIGS. 9A, 10A, and 11A provide cross-sectional top views and FIGS. 9B, 10B, and 11B provide cross-sectional side views from the aft direction A. Also, FIGS. 9A-10B depict the second member 220 of the stock 200 in the second position, whereas FIGS. 11A-11B depict the second member 220 of the stock 200 in the first position. Additionally, FIG. 9A and FIG. 9B depict the second release mechanism 260 in the first position, which may prevent the movement of the second member 220 along the longitudinal axis relative to the first member 210, and FIGS. 10A-11B depict the second release mechanism 260 in the second position, which may allow a movement of the second member 220 along the longitudinal axis relative to the first member 210.

Referring to FIGS. 9A and 9B, which depict the second member 220 in the first position and the second release mechanism 260 in the second position, the second release mechanism 260 may include at least one movable component 261. For example, and as depicted in FIGS. 9A and 9B, the second release mechanism 260 may include a pair of movable components 261 (e.g., actuators, such as push buttons, pins, or the like), a first movable component 261*a* and a second movable component 261*b* (each also referred to as "261"). Each of the movable components 261 may be configured to move in the lateral direction Z. For example, the first movable component 261*a* and the second movable component 261*b* may be configured to move toward and away from each other in the lateral direction Z.

Referring briefly to FIG. 12, each movable component 261 of the second release mechanism 260 may include a slot 262. The slot 262 may have a shape that is generally cuboid shaped with or without rounded edges. Each movable component 261 may include a pocket 265. The pocket 265 may have a shape that is generally partially elliptical cylinder or part cylinder shaped. The slot 262 and the pocket 265 may extend through a width of the movable component 261 along the lateral direction X. Each movable component 261 may include a portion 266 that does not include the pocket 265 and defines a surface that extends in the lateral direction Z.

Turning to FIG. 14, the second release mechanism 260 may include one or more pins 264 that each extend in the lateral direction X and may be configured to be positioned within a slot 262 of a corresponding movable component 261. Each pin 264, in conjunction with the slot 262 of the corresponding movable component 261, may be configured to restrict an inward and/or outward movement of the corresponding movable component 261 in the lateral direction Z.

Referring back to FIGS. 9A-9B, the second release mechanism 260 may include a biasing device 263 that extends in the lateral direction Z and is positioned between the pair of movable components 261. The pair of movable components 261 may be configured to compress the biasing device 263 such that a compression of the biasing device 263 is greater when the release mechanism is in the second position (FIGS. 10A-11B) than when the release mechanism is in the first position (FIGS. 9A-9B). The biasing device 263 may exert an outward force in the lateral direction on each of the one or more movable components 261.

As discussed, when the second release mechanism 260 is in the first position, as depicted in FIGS. 9A and 9B, a movement of the second member 220 along the longitudinal axis relative to the first member 210 may be prevented. For example, each aft guide rod 290 may include one or more depression 291. When the movable components 261 are aligned with one of the one or more depressions 291 of a corresponding aft guide rod 290, each of the movable components 261 may be pushed outward in the lateral direction Z by the biasing device 263. In various examples, and as depicted in FIGS. 9A and 9B, when the movable components 261 are in their outward position, the second release mechanism 260 is in the first position and the portion 266 (FIG. 12) of the movable component 261 that does not include the slot 262 is positioned within the corresponding depression 291 of the aft guide rod 290. The positioning of the portion 266 of the movable component 261 that does not include the slot 262 within the corresponding depression 291 of the aft guide rod 290, as depicted in FIG. 9B, may prevent the movement of the aft guide rod 290 in relation to the movable component 261 in the longitudinal direction X. Because the aft guide rod 290 is rigidly coupled to, or integral with, the second member 220, the movement of the second member 220 relative to the movable component 261 may be prevented. Also, because the movable component 261 may be coupled to the first member 210, the movement of the second member 220 relative to the first member 210 may be prevented.

Referring now to FIGS. 10A-11B, which depicts the second release mechanism 260 in the second position, a movement of the second member 220 along the longitudinal axis X relative to the mount 230 is allowed (e.g., not prevented) when the second release mechanism 260 is in the second position. For example, when the second release mechanism 260 is in the second position, the movable components 261 are pushed inward. When the movable components 261 are pushed inward, the pocket 265 of the movable component 261 aligns with the corresponding aft guide rod 290 and allows the aft guide rod 290 to be positioned within the pocket 265 of the movable component 261. When the aft guide rod 290 is positioned within the pocket 265 of the movable component 261, the aft guide rod 290 is allowed to move in the longitudinal direction X.

Therefore, when the second release mechanism 260 is in the second position, the second member 220 may move from the second position (FIGS. 10A and 10B) to the first position (FIGS. 11A and 11B), and vice-versa.

In various examples, the second release mechanism 260 is prevented from moving from the second position (e.g., movable components 261 positioned inward) to the first position (e.g., movable component 261 positioned outward) when the second member 220 is in a position other than the second position. For example, the second release mechanism 260 is prevented from moving from the second position to the first position when the second member 220 is in the first position. In such embodiments, the second member 220 may not be rigidly held in the first position (e.g., the second member may not be rigidly held collapsed). For example, each aft guide rod 290 may only include one depression 291 that is proximate to a forward end of the aft guide rod 290 which allows the movable component 261 to move from the second position to the first position when the second member 220 is in the second position.

As such, when the movable component 261 is not aligned with the depression 291, the second release mechanism 260 is prevented from moving from the second position by the lateral sides of the aft guide rods 290. Preventing the second release mechanism 260 from moving from the second position may maintain a side load friction on the aft guide rod 290 by the second release mechanism 260, which may prevent the second member 220 from moving relative to the second release mechanism 260. Preventing the second member 220 from moving relative to the second release mechanism 260 may be beneficial because it may lightly prevent the undesired movement of the second member 220 from, for example, tilting the stock 200 but it may allow the movement of the second member 220 by, for example, a force exerted by a user's hand in the aft direction A. Notably, including only one depression 291 that is proximate to a forward end of the aft guide rod 290 allows the second member 220 to move from the first position to the second position without a user interacting with the second release mechanism 260, which may be beneficial. In some embodiments, each aft guide rod 290 may include a plurality of depressions 291 that may allow the second release mechanism 260 to move from the second position to the first position at various locations along the length of the aft guide rod 290.

Referring back to FIG. 3, the first member 210 may define a cheek rest surface 212 and the second member 220 may define a cheek rest surface 222. In various examples, the stock 200 may define a continuous cheek rest surface 201 that extends from a position proximate to a forward end of the first member 210 to a position proximate to an aft end of the second member 220 when the second member 220 is in the second position. In some examples, the tube 120 defines a cheek rest surface 122. As such, in various examples, the stock 200 may define a continuous cheek rest surface 201 that extends from a position proximate to a forward end of the tube 120 (e.g., an aft end of the main body 110) to a position proximate to an aft end of the second member 220 (e.g., butt portion 224) when the first member 210 and the second member 220 are in their second positions.

Each cheek rest surface 122, 212, 222 may be an exterior surface that allows an individual to comfortably position their cheek on the cheek rest surface 122, 212, 222 to, for example, align their eye with the sites of the firearm 100. Each cheek rest surface 122, 212, 222 may extend circumferentially, at least partially, around the longitudinal axis. For example, each cheek rest surface 122, 212, 222 may extend at least eighty degrees, such as at least ninety degrees, such as at least 120 degrees, such as at least 180 degrees circumferentially around the longitudinal axis L.

Providing a continuous cheek rest surface 201 that extends at least from the position proximate to the forward end of the first member 210 to the position proximate to the aft end of the second member 220 when the second member 220 is in the second position has various benefits. For example, it allows an individual to comfortably place their cheek on the first member 210 or the second member 220 when the stock 200 is in a fully collapsed state, a partially extended state, and a fully extended state.

Referring now to FIG. 15 a method 700 for transitioning a stock 200 for a firearm 100 from a fully extended state (i.e., both the first member 210 and the second member 220 in the second position) to a fully collapsed state (i.e., both the first member 210 and the second member 220 in the first position) is provided, in accordance with an example embodiment. The method 700 may include a step 710 of moving a first release mechanism 250 of the stock 200 from a first position to a second position. For example, the movable component 251 of the first release mechanism 250 may be move in the aft direction A by, for example, an individual's finger. Moving the first release mechanism 250 in the aft direction A may move the wedge member 252 aft and allow the deflectable component 255 to leave the second depression 281*b* of the forward guide rod 280.

The method 700 may include a step 730 of moving a first member 210 of the stock 200 in a forward direction F from a second position to a first position when the first release mechanism 250 is in the second position. Moving the first member 210 of the stock 200 in a forward direction F may be done by an individual while they are also maintaining the position of the first release mechanism 250 in the second position.

The method 700 may include a step 750 of moving a second release mechanism 260 of the stock 200 from a first position to a second position. For example, the pair of movable components 261 of the second release mechanism 260 may be moved inward by, for example, an individual's fingers. Moving the pair of movable component 261 of the second release mechanism 260 may align the pocket 265 of the movable component 261 with the aft guide rod 290 in the longitudinal direction X.

The method 700 may include a step 770 of moving a second member 220 of the stock 200 in the forward direction F from a second position to a first position when the second release mechanism 260 is in the second position. For example, an individual can move the second member 220 of the stock 200 in the forward direction F until the second member 220 is in the first position.

To transition the stock 200 of the firearm 100 from a fully collapsed state to a fully extended state, the steps may be similar to the steps of method 700 for transitioning the stock 200 from the fully extended state to the fully collapsed state. However, instead of moving the first member 210 and the second member 220 forward, they are moved aft. In various embodiments, the first member 210 and second member 220 may be moved in any sequence, including simultaneously, between the collapsed and expanded states and actuation of the release mechanisms may be similarly coordinated. In this manner, although FIG. 15 depicts steps 710 and 730 occurring before steps 750 and 770, they may be performed simultaneously, overlappingly, and/or the second member/release mechanism steps (750, 770) may be initiated first.

When the stock 200 is in a fully collapsed state, as depicted in FIGS. 1, 8, 11A, and 11B, the tube 120 may be nested within the first member 210 and the tube 120 and the first member 210 may be nested within the second member 220 (e.g., in a telescoping relationship). For example, and as depicted in FIG. 8, an aft facing surface of the tube 120 may align with, make contact with, and/or be in close proximity to, a forward facing surface of an aft end of the first member 210. Also, an aft facing surface of the first member 210 may align with, make contact with, and/or be in close proximity to, a forward-facing surface of an aft end of the second member 220.

Also, when the stock 200 is in a fully collapsed state, the first member 210 and the second member 220 are telescoped toward the main body 110 of the firearm 100. For example, the tube 120, the first member 210, and the second member 220 each define partially concentric and generally tubular components. As such, the tube 120 may be positioned within the first member 210, and the first member 210 may be positioned within the second member 220. In contrast, when the stock 200 is in a fully extended state, as depicted in FIGS. 2-5, the first member 210 and the second member 220 are telescoped away from the main body 110 of the firearm 100.

As will be appreciated, the firearm 100 and stock 200 according to the various examples provided, has various benefits. For example, because the first member 210 and the second member 220 may be telescoped away from the main body 110 of the firearm 100, the length of the stock 200 in the longitudinal direction (e.g., distance from the mount 230 to the butt portion 224) when the stock 200 is in the fully extended state (as depicted in FIG. 2) may be longer than the fully extended lengths of traditional stocks. Also, because the first member 210 and the second member 220 may be telescoped toward the main body 110 of the firearm 100, the length of the stock 200 when the stock 200 is in the fully collapsed state (as depicted in FIG. 1) may be shorter than the fully collapsed lengths of traditional stocks. For example, because the stock 200 may telescope toward and away from the main body 110 of the firearm 100, the fully extended length of the stock 200 (as depicted in FIG. 2) may be more than twice as long as the fully collapsed length of the stock 200 (as depicted in FIG. 1). As will also be appreciated, having a stock that may be telescoped such that the fully extended length of the stock 200 may be more than twice as long as the fully collapsed length of the stock 200 may be beneficial because it increases the usability of the stock 200 in confined areas, such as within vehicles or small rooms, while also increasing the usability of the stock 200 in non-confined areas.

CONCLUSION

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions may be implemented for performing the same, similar, alternative, or substitute functions of the disclosed subject matter, and are therefore considered within the scope of this disclosure. Therefore, the disclosed subject matter should not be limited to any single embodiment described herein, but rather should be construed in breadth and scope in accordance with the appended claims below. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A stock for a firearm, the firearm having a main body, the stock defining a longitudinal axis, the stock comprising:

a mount that is configured to be coupled to the main body of the firearm;

a first member that is configured to move along the longitudinal axis between a collapsed position of the first member and an extended position of the first member relative to the mount;

a second member that is configured to move along the longitudinal axis between a collapsed position of the second member and an extended position of the second member relative to the first member, wherein when the second member is in the extended position of the second member, the second member is positioned at least partially aft of the first member; and a release mechanism that is configured to be in a first position and in a second position, wherein when the release mechanism is in the first position, the release mechanism is configured to prevent a movement of the second member along the longitudinal axis relative to the first member, and wherein when the release mechanism is in the second position, the release mechanism is configured to allow the movement of the second member along the longitudinal axis relative to the first member.

2. The stock of claim 1, further comprising a release mechanism that is configured to be in a first position and in a second position, wherein when the release mechanism is in the first position, the release mechanism is configured to prevent a movement of the first member along the longitudinal axis relative to the mount, and wherein when the release mechanism is in the second position, the release mechanism is configured to allow the movement of the first member along the longitudinal axis relative to the mount.

3. The stock of claim 1, wherein the stock defines a lateral direction, wherein the release mechanism comprises a pair of movable components and a biasing device that is positioned between the pair of movable components in the lateral direction, wherein the pair of movable components are configured to compress the biasing device, and wherein a compression of the biasing device is greater when the release mechanism is in the second position than when the release mechanism is in the first position.

4. The stock of claim 1, wherein when the first member and the second member are each in their respective collapsed position, the stock is in a fully collapsed state, and wherein when the first member and the second member are each in their respective extended position, the stock is in a fully expanded state.

5. The stock of claim 4, wherein when one of the first member or the second member is in their respective collapsed position and the other of the first member or the second member is in their respective extended position, the stock is in a partially extended state.

6. A stock for a firearm, the firearm having a main body, the stock defining a longitudinal axis and a longitudinal direction, the stock comprising:

a mount that is configured to be coupled to the main body of the firearm;

a first member that is configured to move along the longitudinal axis between a collapsed position of the first member and an extended position of the first member relative to the mount;

a second member that is configured to move along the longitudinal axis between a collapsed position of the second member and an extended position of the second member relative to the first member, wherein when the second member is in the extended position of the second member, the second member is positioned at least partially aft of the first member; and a release mechanism that is configured to be in a first position and in a second position, wherein when the release mechanism is in the first position, the release mechanism is configured to prevent a movement of the first member along the longitudinal axis relative to the mount, wherein when the release mechanism is in the second position, the release mechanism is configured to allow the movement of the first member along the longitudinal axis relative to the mount, wherein the release mechanism comprises a movable component that is coupled to a wedge member that is configured to move with the movable component, wherein the wedge member comprises a surface that extends at an angle relative to the longitudinal direction, and wherein the angle is at least fifty degrees and up to seventy degrees.

7. The stock of claim 6, wherein the longitudinal direction defines a forward direction and an aft direction, wherein the release mechanism comprises a biasing device that is coupled to the wedge member, wherein the biasing device is configured to bias the wedge member in the forward direction.

8. The stock of claim 6, wherein the surface is a second surface, and the wedge member further comprises a first surface that is adjacent to the second surface, wherein the first surface extends at a first angle relative to the longitudinal direction, and wherein the first angle is at least twenty degrees and up to forty degrees.

9. A stock for a firearm, the firearm having a main body, the stock defining a longitudinal axis, the stock comprising:

a mount that is configured to be coupled to the main body of the firearm;

a first member that is configured to move along the longitudinal axis between a collapsed position of the first member and an extended position of the first member relative to the mount;

a second member that is configured to move along the longitudinal axis between a collapsed position of the second member and an extended position of the second member relative to the first member, wherein when the second member is in the extended position of the second member, the second member is positioned at least partially aft of the first member; and a release mechanism that is configured to be in a first position and in a second position, wherein when the release mechanism is in the first position, the release mechanism is configured to prevent a movement of the first member along the longitudinal axis relative to the mount, wherein when the release mechanism is in the second position, the release mechanism is configured to allow the movement of the first member along the longitudinal axis relative to the mount, and wherein the stock comprises a forward guide rod that is coupled to the mount, the forward guide rod comprising a first depression and a second depression, and wherein the release mechanism comprises a deflectable component that is configured to move from the first depression to the second depression when the first member is moved from the collapsed position of the first member to the extended position of the first member.

10. A firearm comprising:

a main body comprising a lower receiver;

a tube that is coupled to the lower receiver;

a stock that defines a longitudinal axis and at least partially extends circumferentially around the tube, wherein the stock comprises:

a mount that is configured to be coupled to the main body of the firearm;

a first member that is configured to move along the longitudinal axis between a collapsed position of the first member and an extended position of the first member relative to the mount; and a second member that is configured to move along the longitudinal axis between a collapsed position of the second member and an extended position of the second member relative to the first member, wherein when the second member is in the extended position of the second member, the second member is positioned at least partially aft of the first member;

a forward guide rod that is coupled to the mount; and an aft guide rod that is coupled to the second member, wherein the first member is slidingly engaged with the forward guide rod and the aft guide rod, and wherein the forward guide rod is positioned exterior to the tube.

11. The firearm of claim 10, wherein the stock comprises a release mechanism assembly that is integral with the first member.

12. A stock for a firearm, the firearm having a main body, the stock defining a longitudinal axis, the stock comprising:

a mount that is configured to be coupled to the main body of the firearm;

a first member that is configured to move along the longitudinal axis between a collapsed position of the first member and an extended position of the first member relative to the mount; and a second member that is configured to move along the longitudinal axis between a collapsed position of the second member and an extended position of the second member relative to the first member, wherein when the second member is in the extended position of the second member, the second member is positioned at least partially aft of the first member, wherein the first member comprises a cheek rest surface that extends circumferentially around the longitudinal axis at least 90 degrees, and wherein the second member comprises a cheek rest surface that extends circumferentially around the longitudinal axis at least 90 degrees.

13. The stock of claim 12, wherein a continuous cheek rest surface extends from a position proximate to a forward end of the first member to a position proximate to an aft end of the second member.

14. A firearm comprising:

a main body comprising a lower receiver;

a tube that is coupled to the lower receiver; and a stock that defines a longitudinal axis and at least partially extends circumferentially around the tube, wherein the stock comprises:

a mount that is configured to be coupled to the main body of the firearm;

a first member that is configured to move along the longitudinal axis between a collapsed position of the first member and an extended position of the first member relative to the mount; and a second member that is configured to move along the longitudinal axis between a collapsed position of the second member and an extended position of the second member relative to the first member, wherein when the second member is in the extended position of the second member, the second member is positioned at least partially aft of the first member, and wherein when the first member and the second member are in their respective collapsed position, (i) the tube is at least partially nested within the first member and (ii) the first member is at least partially nested within the second member.

15. The firearm of claim 14, wherein when the first member and the second member are in their respective extended position, the first member and the second member are telescoped away from the firearm.

16. The firearm of claim 14, wherein the first member comprises a cheek rest surface that extends circumferentially around the longitudinal axis at least 90 degrees, wherein the second member comprises a cheek rest surface that extends circumferentially around the longitudinal axis at least 90 degrees, and wherein the cheek rest surface is configured such that an eye of an individual is aligned with a site of the firearm when a cheek of the individual is positioned on the cheek rest surface.

17. The firearm of claim 16, wherein a continuous cheek rest surface extends from a position proximate to a forward end of the tube to a position proximate to an aft end of the second member.

18. The firearm of claim 14, wherein the stock comprises a release mechanism that is configured to be in a first position and in a second position, wherein when the release mechanism is in the first position, the release mechanism is configured to prevent a movement of the first member along the longitudinal axis relative to the mount, and wherein when the release mechanism is in the second position, the release mechanism is configured to allow the movement of the first member along the longitudinal axis relative to the mount.

19. The firearm of claim 14, wherein the stock comprises a release mechanism that is configured to be in a first position and in a second position, wherein when the release mechanism is in the first position, the release mechanism is configured to prevent a movement of the second member along the longitudinal axis relative to the first member, and wherein when the release mechanism is in the second position, the release mechanism is configured to allow the movement of the second member along the longitudinal axis relative to the first member.

20. A method for transitioning a stock for a firearm from a fully extended state to a fully collapsed state, wherein the firearm comprises:

a main body comprising a lower receiver;

a tube that is coupled to the lower receiver;

a stock that defines a longitudinal axis and at least partially extends circumferentially around the tube, wherein the stock comprises:

a mount that is configured to be coupled to the main body of the firearm;

a first member that is configured to move along the longitudinal axis between a collapsed position of the first member and an extended position of the first member relative to the mount; and a second member that is configured to move along the longitudinal axis between a collapsed position of the second member and an extended position of the second member relative to the first member;

a forward guide rod that is coupled to the mount; and an aft guide rod that is coupled to the second member, wherein the first member is slidingly engaged with the forward guide rod and the aft guide rod, wherein the forward guide rod is positioned exterior to the tube, wherein the method comprises:

moving a first release mechanism of the stock from a first position to a second position;

moving the first member of the stock in a forward direction from the extended position of the first member to the collapsed position of the first member when the first release mechanism is in the second position;

moving a second release mechanism of the stock from a first position to a second position; and moving the second member of the stock in the forward direction from the extended position of the second member to the collapsed position of the second member when the second release mechanism is in the second position, wherein when the second member is in the extended position of the second member, the second member is positioned at least partially aft of the first member, wherein when the first member and the second member are in their respective extended positions, the stock is in the fully extended state, and wherein when the first member and the second member are in their respective collapsed positions, the stock is in the fully collapsed state.

* * * * *